US008590618B2

(12) United States Patent
Jelsma

(10) Patent No.: US 8,590,618 B2
(45) Date of Patent: Nov. 26, 2013

(54) METHOD AND APPARATUS FOR SINGLE RUN CUTTING OF WELL CASING AND FORMING SUBSURFACE LATERAL PASSAGES FROM A WELL

(75) Inventor: Henk H. Jelsma, Spring, TX (US)

(73) Assignee: Radial Drilling Services, Inc., Spring, TX (US)

( * ) Notice: Subject to any disclaimer, the term of this patent is extended or adjusted under 35 U.S.C. 154(b) by 306 days.

(21) Appl. No.: 13/065,922

(22) Filed: Apr. 1, 2011

(65) Prior Publication Data

US 2011/0247815 A1 Oct. 13, 2011

Related U.S. Application Data

(60) Provisional application No. 61/341,814, filed on Apr. 5, 2010.

(51) Int. Cl.
*E21B 43/11* (2006.01)

(52) U.S. Cl.
USPC ..... 166/298; 166/55.7

(58) Field of Classification Search
USPC ..... 166/297, 298, 55.7, 55.8; 175/62, 424
See application file for complete search history.

(56) References Cited

U.S. PATENT DOCUMENTS

| | | | | |
|---|---|---|---|---|
| 2007/0125577 | A1* | 6/2007 | Brunet | 175/62 |
| 2009/0101414 | A1* | 4/2009 | Brunet et al. | 175/62 |
| 2009/0288884 | A1* | 11/2009 | Jelsma | 175/67 |
| 2011/0290561 | A1* | 12/2011 | Randall et al. | 175/50 |

* cited by examiner

*Primary Examiner* — William P Neuder
(74) *Attorney, Agent, or Firm* — Osha • Liang LLP

(57) ABSTRACT

An apparatus and system for a single run process for well installations to cut or mill away a section of the casing of a well and then position an attached deflecting device to form radial boreholes or passages in a production formation that is intersected by the wellbore. This invention allows the lateral boreholes to be selectively oriented angularly upwardly or downwardly in relation to the casing space that has been formed or oriented in selectively radially spaced relation if desired.

14 Claims, 5 Drawing Sheets

METHOD AND APPARATUS FOR SINGLE RUN CUTTING OF WELL CASING AND FORMING SUBSURFACE LATERAL PASSAGES FROM A WELL

Applicant hereby claims the benefit of U.S. Provisional Application Ser. No. 61/341,814 filed on Apr. 5, 2010 by Henk H. Jelsma and entitled "Method and Apparatus For Single Run Cutting of Well Casing and Forming Subsurface Lateral Passages From a Well", which Provisional Application is incorporated herein by reference for all purposes.

BACKGROUND OF THE INVENTION

1. Field of the Invention

The present invention is directed generally to methods and apparatus for enhancing the production of petroleum products from existing wells, especially wells that have become somewhat depleted or wells that require lateral passages extending into the surrounding formation for stimulation of efficient production. More particularly, the present invention concerns methods and apparatus for single run cutting or milling a section of well casing from the casing string of an existing well to form a casing interval, precisely locating lateral passage forming apparatus with respect to the casing interval and forming one or more lateral passages that extend from the casing interval a considerable distance into the surrounding subsurface production formation that is intersected by the wellbore. More specifically, the present invention concerns a method and apparatus for accomplishing, in a single run or trip of equipment into a wellbore, a casing cutting or milling operation to form a casing interval exposing the surrounding formation, positioning of lateral production passage forming apparatus and jetting or otherwise forming one or more lateral passages from the casing interval into the formation.

2. Description of the Prior Art

Many wells have been drilled for production of petroleum products over the years and many of these wells have ceased efficient production due to a variety of reasons. Typically wells are drilled and as part of the drilling process the wells are lined with well casing that is cemented to the formation. Completion of the wells is typically accomplished by perforating the casing via the use of explosive well perforation charges. In later years the production of such wells has been stimulated by drilling, milling or cutting openings in the casing and then landing and orienting lateral passage drilling or jetting tools at a designated depth for generating lateral passages into the surrounding formation. Typically a landing tool is run into the well casing and is secured at a desired depth in relation to the depth of the formation of interest. Then a casing milling or casing cutting tool is run into the well casing to the desired depth, is landed on the landing tool in properly oriented position and is activated to mill an opening or cut an interval in the well casing so as to expose the surrounding production formation. The casing milling or cutting tool is then pulled from the well casing and a lateral passage drilling or jetting tool is run into the casing string and is landed on the landing tool and secured in place. The lateral passage drilling or jetting tool is then activated to form one or more lateral passages that extend from the casing opening or casing interval to a desired depth within the formation. These lateral passages typically enhance the collection and production of petroleum products from the formation.

The potential for stimulating well production by forming lateral passages should be accomplished by minimal well service time and at minimal cost; otherwise the cost of achieving enhanced well production, from the standpoint of labor, material and equipment, could far exceed the benefit to the operator of the well. It is desirable therefore to minimize service costs by achieving casing milling or cutting and lateral passage formation by running into the casing a tool that has the capability of effectively performing both operations in a single run or trip so that labor and machinery costs can be as low as possible.

Existing casing cutting or milling products found in the marketplace include section mills which cut a section of casing in a well. Other casing cutter products that are presently available in the well servicing industry include devices which contain blades that are provided on outwardly moving arms to cut a section of well casing when the arms are rotated. These arms are typically moved outwardly by the flow of fluid pumped through a tubular work string from fluid pumps that are components of the surface equipment. Other casing cutter mechanisms of the petroleum industry include mills which are actuated to cut a rectangular opening or window in the casing to allow the lateral exit movement of a drill bit from a drilling tool for drilling a lateral passage into the formation. Similar types of lateral passage tools include jetting hoses and nozzles that are directed laterally into the formation simultaneously with directing a high pressure jet of fluid against the formation to blast or erode a lateral passage extending from the wellbore into the surrounding production formation.

Casing cutting devices have been developed and used which include devices employing high pressure water to cut a section of casing or which use abrasive fluids to cut, erode or blast away a section of casing to develop a hole in the casing that exposes the surrounding earth formation. It is obvious that existing products and techniques using abrasive materials in the fluid for the purpose of jet blasting or erosion of the well casing can be very damaging to the surface equipment, such as pumps, valves, fluid handling conduits and the like, thus requiring significant equipment maintenance, repair and replacement for casing interval cutting operations or casing window cutting operations. Also, it is known that existing products and techniques employing high pressure jet drills can create damage to the surface and conveyance equipment, thus adding to the cost and adversely affecting the commercial viability of subsurface lateral passage formation techniques.

Some casing cutter devices that are available to the petroleum production industry at the present time may cut a casing interval from the bottom up, i.e., penetrating the well casing wall in a casing cutting operation and then moving the cutting elements upwardly from the point of casing penetration to cut away a section of casing and form a casing interval from which lateral bores or passages may be subsequently formed by separate drilling or jetting operations. These types of casing cutter typically develop an uneven, perhaps jagged upwardly facing annular shoulder on the casing that remains below the casing interval. If this annular shoulder is to be employed to enable precision landing and positioning of other well service equipment, it can be quite difficult to achieve the degree of landing and positioning accuracy that is needed.

Casing cutting systems have also been developed which employ drills that cut a single hole in the well casing wall for the purpose of installing a lateral borehole by a jetting process. The casing opening or window drilling apparatus is employed for the single purpose of forming a hole of desired diameter in the well casing, after which the drilling apparatus is retrieved from the well. Lateral passage drilling or jetting apparatus is then run into the well to the desired depth and is activated to form a single lateral passage into the surrounding formation. This process necessitates running different equipment into a well casing, multiple times to form multiple lateral passages that radiate into the formation from the well casing, thus significantly adding to the service time and cost of lateral passage formation and perhaps failing to achieve the commercial viability of the well servicing operation.

A problem with existing products and techniques for lateral passage formation is that they require significant surface equipment at the surface of the well site to operate the various types of equipment that are required to cut a section of casing. These existing casing cutting and lateral passage forming systems require additional trips of equipment into and out of the well casing to cut a section of casing and then to land and orient a deflector device to install lateral boreholes. Casing cutting systems that are in use at the present time generally cut from the bottom up, which does not leave a clean ledge on the lower end of the section or interval cut. The cutters of these types of devices are extended from a casing cutting tool and then moved laterally or pivotally into and through the wall of the casing. This method of cutting a well casing can develop an irregular upwardly facing shoulder on the casing below the interval that is cut. This irregular upwardly facing annular shoulder can adversely affect the precision that is needed for landing equipment at the interval and preparing that equipment for subsequent jetting or drilling operations to form the desired lateral passages.

Another problem with existing casing cutting systems and techniques is that it may require several well servicing trips to enable running, landing and positioning of the desired equipment to cut a section of casing and then to subsequently accurately land a deflector device in oriented position relative to the casing interval for drilling or jetting formation of the lateral boreholes from the casing interval into the formation.

SUMMARY OF THE INVENTION

The principal object or feature of this invention is to provide a novel mechanism and system for cutting a section of well casing at a desired depth within a well, defining an upwardly facing and sharply defined casing ledge or shoulder and subsequently to land a deflector device of a single run casing cutting and lateral passage forming on the resulting ledge or shoulder from which lateral passages can be jetted or otherwise formed.

An important object or feature of this invention is the provision of a single run method and apparatus for installing multiple lateral boreholes within the surrounding earth formation from a single section or interval that is cut from the well casing to expose the formation material.

Another object of this invention is to allow the section of casing to be cut and the deflector device for the jetting of the lateral passages to be landed and utilized in a single trip, thus providing effective well servicing at minimal labor and equipment costs.

It is also an object of this invention to allow a selected section of casing to be cut and to permit the deflector device for the jetting of the lateral passages to be oriented at least once and preferably a number of times for development of lateral formation passages without necessitating pulling of the casing cutting apparatus from the well.

An object of this invention is to cut a section of casing using a conventional section mill device, and to subsequently land the section mill device on the upwardly facing ledge caused by the termination of this casing cut.

Another object of this invention is to provide a novel method and apparatus permitting selectively oriented lateral passages to be installed within the surrounding formation from a wellbore casing.

An object of this invention is to provide a single device that will cut a section of casing, have the casing cutting blades retract back to the original position, and then have special spring loaded or hydraulically energized locking devices extend radially to land on the upwardly facing circular edge or shoulder of the casing section which has been cut.

A further object of this invention is the provision of a quick and efficient means to allow lateral passages to be jetted from a cased wellbore into the surrounding subsurface production formation with a minimum of equipment running trips.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments. In the Drawings.

DETAILED DESCRIPTION OF PREFERRED EMBODIMENT

Overview

Generic Name: Device to Cut a Casing Section and Achieve Installation of Jetted Laterals.

Description of Invention:

Device and system to cut a section of casing and precisely position and orient a deflector shoe in a single well servicing trip to provide for the installation of one or more lateral passages into a surrounding formation.

The purpose of this invention is to provide a method and apparatus that, during a single trip into the casing of a well, can be controlled from the surface to cut or mill away a section of casing, thus defining a casing interval exposing the surrounding production formation, land the apparatus on a well defined shoulder if the casing that results from the casing cutting process and accurately position a deflector device or shoe relative to the casing interval and then run passage jetting apparatus through a deflector passage of the deflector shoe and jet blast a lateral passage be positioned in a single trip into the wellbore. A further purpose of this invention is to allow a quick and efficient means to cut a section of casing and locate a deflector to install lateral boreholes in a single trip. A further purpose of this invention is to allow the installation of oriented lateral boreholes. Another purpose of this invention is to allow the use of a standard section mill within a system to cut a section of casing and locate a deflector shoe relative to an upwardly facing shoulder surface of the casing in a single trip.

Main Component Name: Section Mill Deflector Assembly

Figure 1:
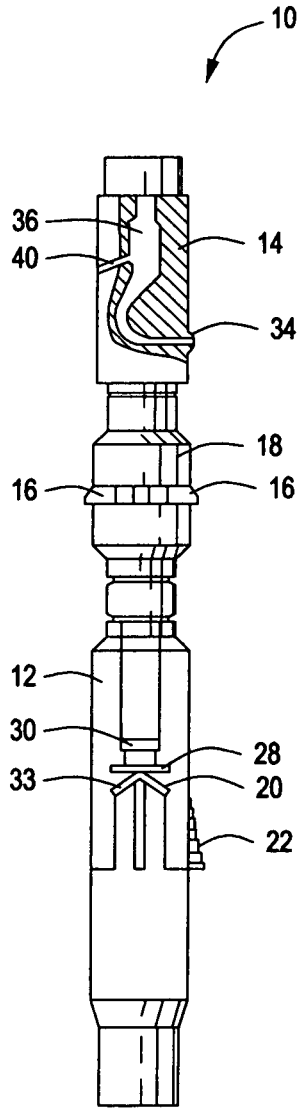
FIG. 1 is an elevation view having a part thereof broken away and shown in section and illustrating a casing cutting or milling and jet deflector assembly embodying the principles of the present invention.
Figure 2:
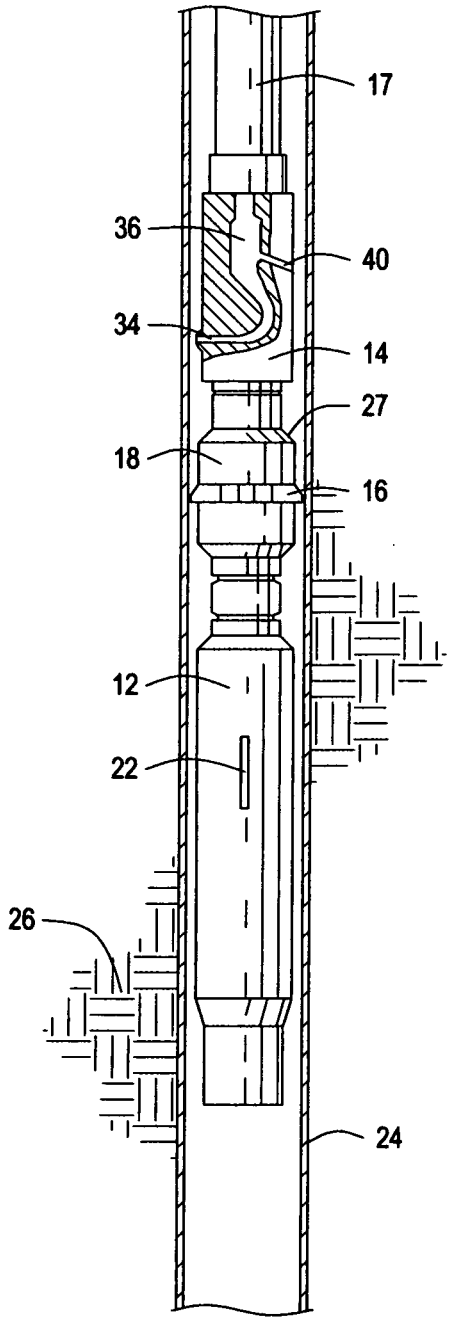
FIG. 2 is an elevation view similar to that of FIG. 1 and showing the casing cutting or milling and jet deflector assembly being connected with a work string or tool and being run through well casing.
Figure 3:
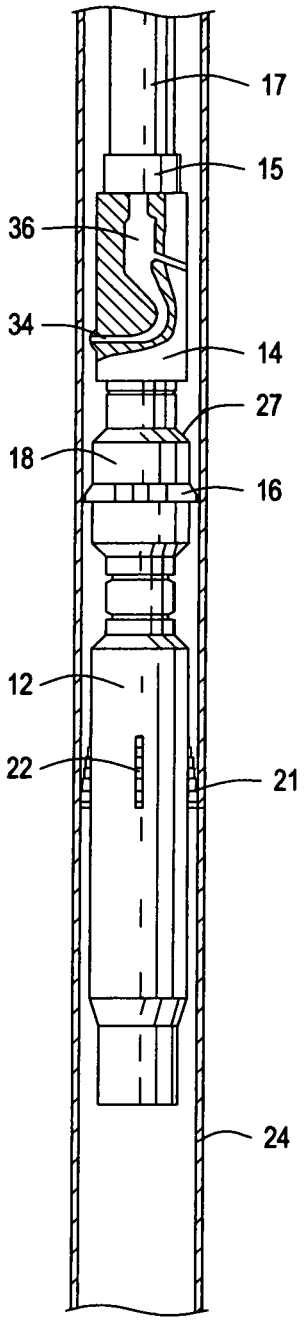
FIG. 3 is an elevation view similar to that of FIGS. 1 and 2 and showing the casing cutting or milling blades extended to cutting relation with the inner surface portion of the well casing.
Figure 4:
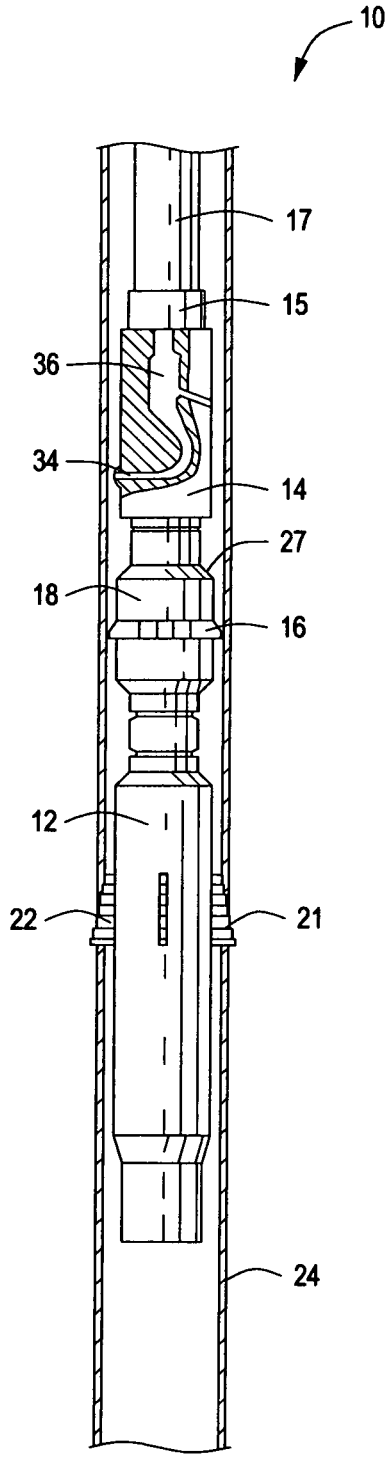
FIG. 4 is an elevation view similar to that of FIG. 3 and showing the casing cutting or milling blades extended through the well casing.
Figure 5:
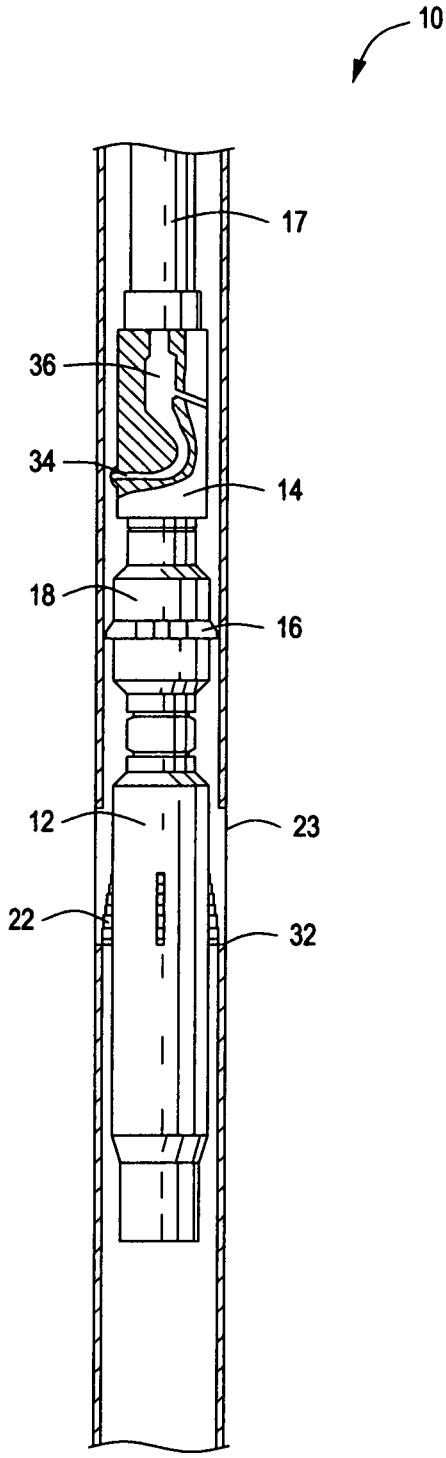
FIG. 5 is an elevation view similar to that of FIG. 4 and showing the casing cutting or milling blades retracted after having cut away a section of the well casing.
Figure 6:
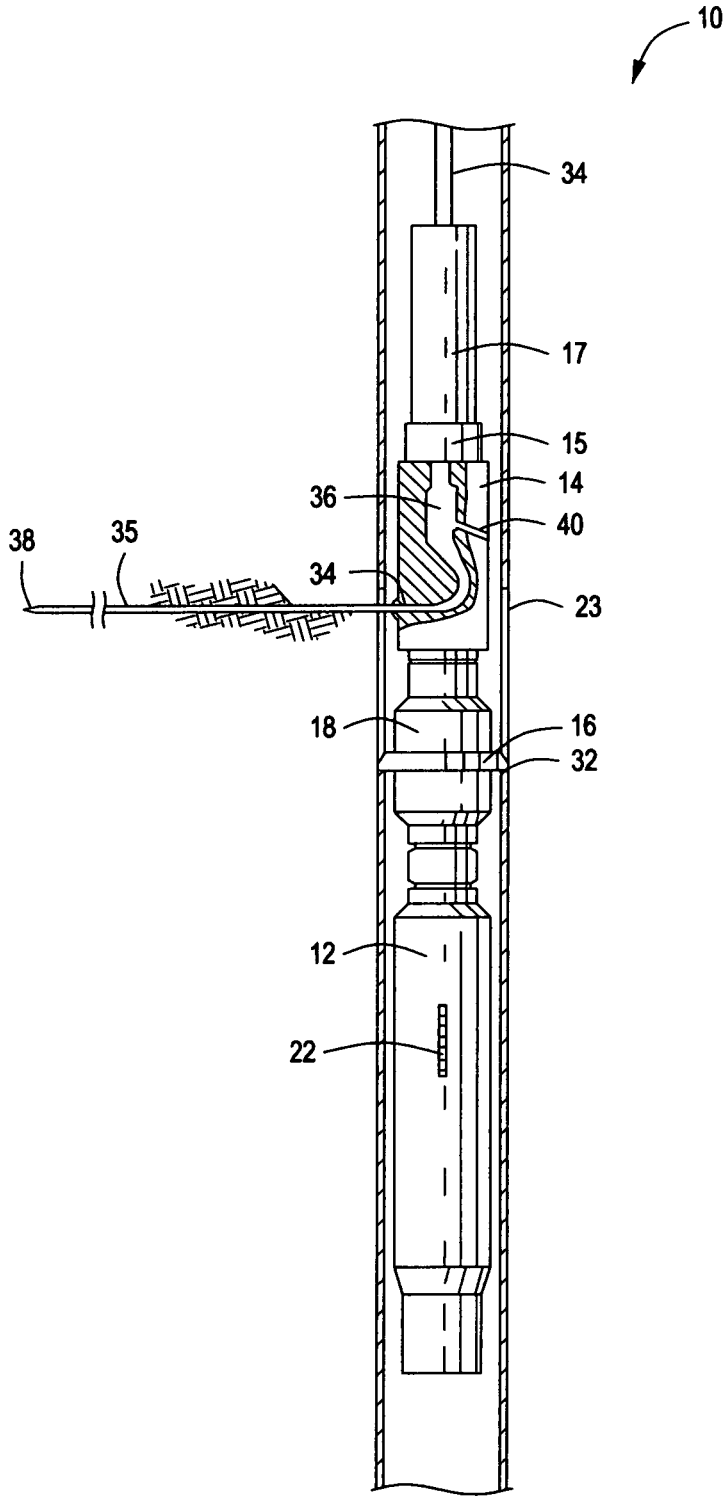
FIG. 6 is an elevation view similar to that of FIG. 5 and showing the positioning lugs of the tool positioning mechanism of the single run apparatus being landed on the upwardly facing rim of the well casing and positioning the jet deflector mechanism for jetting and rotation activity.

Structure of the Section Mill Deflector Assembly:

With reference to the Drawings and first to FIG. 1, a section mill deflector assembly, hereinafter called a "mill deflector", is shown generally at 10, consists of a section mill shown generally at 12 having a deflector shoe 14 located at its upper end, and having spring loaded "locking lugs" 16 that are movably, typically pivotally mounted to the body 18 of the device. The locking lugs are retractable within a landing or positioning body 18 for running of the section mill deflector assembly into the well and are extended from the body 18 by spring action, by hydraulic pressure, or by any other suitable means. When so extended, as shown in FIG. 6 the locking lugs serve as landing elements to engage and be accurately positioned by a smoothly cut casing ledge 32 that is formed during downwardly actuated cutting or milling of the casing as will be explained below.

The deflector shoe 14 has a connector 15 at its upper end to facilitate connection of the section mill deflector assembly to a work-string 17 that enables the section mill deflector assembly to be raised, lowered and rotatably positioned by well servicing apparatus that is located at the surface. Also located at the surface is lateral passage forming apparatus, including fluid pumps, hose or tubing for fluid injection and reels for supporting the hose or tubing and for controllably moving the hose or tubing through the well casing and through the deflecting shoe 14 to jet blast lateral passages from the wellbore into the surrounding formation.

The section mill 12 is defined by a landing or positioning body structure 21 that is supported below the landing or positioning body 18 by a connector section 19. The landing or positioning body structure 21 defines a plurality of blade exit slots 25 within which are located a plurality of movably mounted blades or cutter elements 22. The blades or cutter elements are preferably connected with pressure activated arms 20 within the body 12 that have the cutters 22 located at the extreme ends thereof. A pressure energized hydraulic piston 30 is actuated by hydraulic pressure of fluid pumped from the surface and accomplishes outward extension of the cutters 22 to their casing cutting positions in response to desired pressure increase within the work string 17. The casing cutters 22 will be moved outwardly by hydraulic pressure thus causing the cutters to penetrate the well casing and project outwardly to their cutting positions.

With the cutters at their cutting positions the section mill deflector assembly is then moved downwardly by control of the work string until a desired section of the casing has been milled away. At the completion of the casing milling process a desired interval of the well casing will have been milled away and an interval of the surrounding formation will have been exposed. Moreover, by milling from the top down the casing below the interval will be left with a smoothly defined upwardly facing circular surface or ledge which provides a precision landing ledge for accurate positioning of the section mill deflector assembly. For precision landing of the section mill deflector assembly 10 the upwardly facing circular ledge 32 of the casing is engaged by the locking lugs 16, thus properly locating the deflecting shoe 14 relative to the casing interval and the surrounding formation in which lateral passages will then be formed by a hydraulic jet blasting operation, by a drilling operation or by any other suitable means. The locking lugs 16 define upwardly directed angulated reaction surfaces 37 that, upon upward movement of the casing section mill deflector assembly within the casing, engage the downwardly facing circular shoulder 31 of the casing that has been cut. As the casing section mill deflector assembly is moved further upward the tapered surfaces 37 provide a resultant force that moves the locking lugs from their extended positions to their retracted positions, thus permitting the casing section mill deflector assembly to be movable upwardly beyond the interval that has been milled.

The casing section mill deflector assembly 10 is rotated as fluid is pumped until the cutters 22 are forced by hydraulic pressure to move outwardly from the slots 25 of the casing cutter housing 21 and establish contact with the inside surface of the casing 24. The rotary motion of the section mill deflector assembly 10 will causes the cutters further expand and cut through the casing. After the casing has been completely penetrated by the rotating cutters the casing cutting control system at the surface will be used to move the housing 21 and the cutters downwardly, thus milling or cutting the casing wall downwardly and cutting away the casing to form an interval that exposes the surrounding formation. This downward cutting or milling movement of the cutters will be continued until the length of the casing interval that exists due to the spacing of the milled ends of the casing will be of sufficient length for precise positioning of the deflector shoe 14 with its jet tube opening 34 located below the downwardly facing end surface 31 of the casing.

In the alternative, the casing mill housing 21 may be provided with a cutter moving mechanism that causes cutter actuation for cutting and causes downward cutter movement to cut the length of casing that is needed for the desired length of casing interval. According to conventional practice the well casing is cemented to the surrounding earth formation 26 and thus, when a section of the casing is cut away, the upper section of the casing will be maintained in place relative to the formation by the cement bond. After the cutters 22 have cut through the casing wall, the fluid pressure activated arms 28, which are actuated by a piston 30, will lock the cutter mechanism in place with the cutters 22 fully extended. With the cutters extended the section mill assembly is lowered to cut away a desired length of the casing and form a space or interval 23 between the opposed end surfaces 31 and 32 of the upper and lower sections of the casing 24.

When a desired section of casing has been cut away, the fluid flow is stopped, which eliminates the cutter actuation pressure on the piston 30 and permits cutter return springs to retract the cutters 22 to their deactivated and retracted positions, thus preparing the section mill deflector assembly to be moved within the casing. At this point the section mill deflector assembly will be raised past the exposed formation interval to a point above the downwardly facing end surface 31 of the uncut portion of the casing. Before or during this upward movement of the section mill deflector assembly the cutters 22 will be retracted to their non-cutting positions within the housing 21. The section mill deflector assembly 10 will then be lowered within the casing until the locking lugs reach the interval that has been cut in the well casing. With the radial clearance that is provided by the casing interval the "locking lugs" 16 will then be extended by spring force to their landing positions. As downward movement of the section mill deflector assembly continues the radially extended locking lugs 16 will land on the upwardly facing circular ledge32 of the casing 32 which is located at the top of the lower portion of the casing which has been cut.

Figure 7:
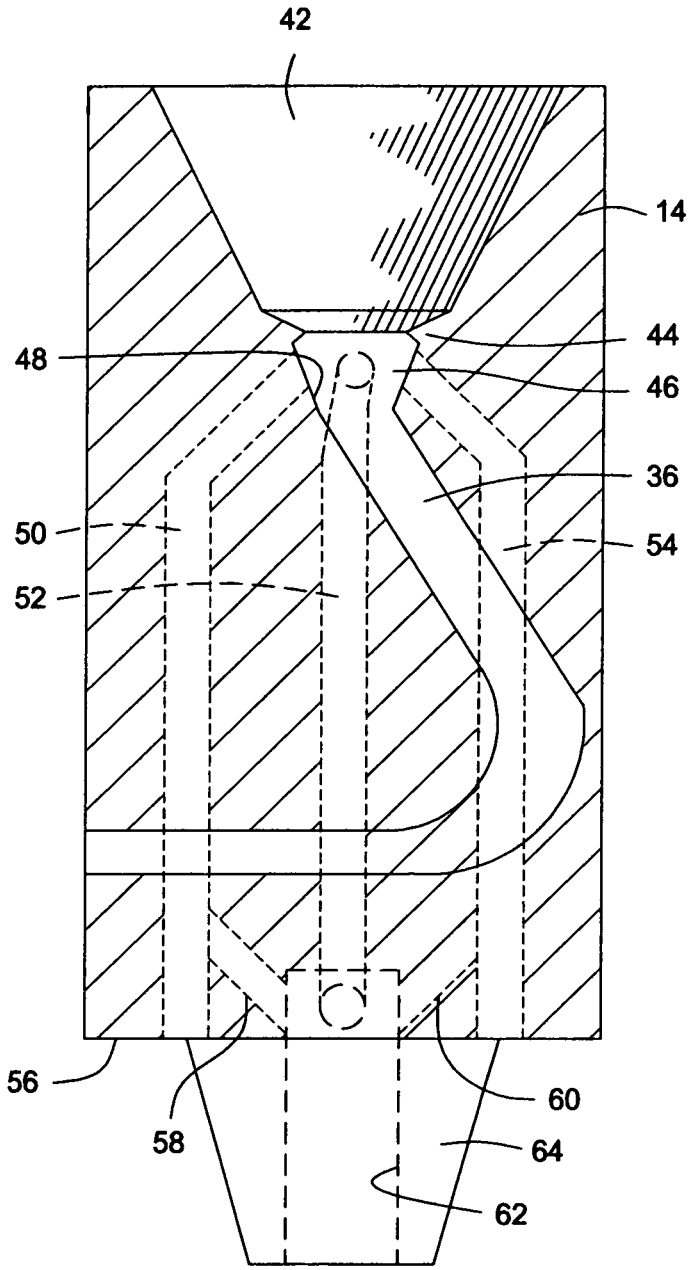
FIG. 7 is a section view of the jet deflector component of a casing cutting and lateral passage forming tool embodying the principles of the present invention and showing by-pass passages that permit fluid to flow past the jet tube deflecting passage of the jet deflector component.

The deflector shoe 14 is shown in the section mill deflector assembly of FIGS. 1-6 and is shown by the section view of FIG. 7. The Deflecting Shoe 14 defines a jet tube transition pathway or passage 36 that is specifically designed with a reverse curve configuration that enables a flexible jet fluid supply tube 34 to pass through the deflector shoe and exit from a jet tube outlet opening 34 with a lateral orientation that enables the jet tube to move laterally into the formation as a jet blasting operation is conducted. The jet tube transition pathway or passage 36 is milled or otherwise formed and has a configuration that causes any device which moves through it to turn to an orientation which is perpendicular to the inside wall of the casing 24. The Deflecting Shoe 14 is typically manufactured by cutting a piece of solid steel bar in half, then subsequently milling an identical pathway groove in each of the two halves. The two halves of the deflecting shoe are then reassembled and bolted or welded together. The deflector shoe 14 has a threaded connection on each end and a hole for exit of the Jetting Nozzle 38 and flexible hose 34 as is shown in FIG. 6.

The deflecting Shoe 14 preferably contains additional fluid bypass passages, such as shown at 40 in FIG. 6 to allow circulation through the Shoe during drilling or completion operations. In FIG. 7 the deflector shoe 14 is shown to define a downwardly and inwardly converging tapered jet tube entry and guide surface 42 which serves to guide a jet nozzle and jet fluid supply tube or hose into the jet tube transition pathway or passage 36 of deflecting shoe. An annular relatively sharp overhang structure 44 is located at the lower end of the guide surface 42 and serves to prevent the jet nozzle and jet fluid supply tube assembly from hanging up as it is moved through the jet tube transition pathway or passage 36 whether being fed into or being pulled out of the jet tube transition pathway or passage 36. Immediately below the overhang structure 44 the deflector shoe defines a tapered receptacle 46 that also serves a tube guiding function and is also defined by a generally conical, downwardly converging receptacle surface 48. Bypass passages shown in broken line at 50, 52 and 54 in FIG. 7 have upper ends that are in communication with the jet tube transition pathway or passage 36 and extend downwardly to an annular downwardly facing shoulder 56. Thus, the bypass passages are in communication with the annulus between the deflector shoe 14 and the internal wall of the well casing. Other bypass passages, such as shown in broken line at 58 and 60 extend from the bypass passages 50, 52 and 54 and intersect a central passage shown in broken line at 62 and extending centrally of a threaded pin connection 64 by which the deflector shoe is connected with the section mill 12.

The Deflector 14 is now in position to receive the flexible hose 35 and to direct it laterally into the target reservoir. An orientation device, such as a surface reading gyroscope, can be lowered through the work-string 17 to land on an orientation profile located at the upper end of the deflector shoe in order to achieve selective lateral orientation of the lateral boreholes if required.

Detailed Description of the Section Mill Deflector Assembly:

The mill deflector assembly consists of a conventional section mill 12 with a set of spring loaded outwardly biased lugs mounted on the housing, with a deflector shoe 14 on the upper end. When fluid is pumped through this device, the cutter "arms" 28 extend out radially, causing the cutters 22 on the end of these arms to contact the inside wall of the casing 24. The device is subsequently rotated by controlled rotation of the work-string by surface equipment, causing the cutters 22 to cut through the casing wall 24. At that point the cutter "arms" are locked in place by a mechanical lock in the device. The device is rotated as weight is applied to cut a section of the casing as the device is moved downward by downward movement of the work-string. After the target length of the space in the well casing has been achieved, the pumping is halted, the rotation stopped and the device is picked up by upward movement of the work-string until it is fully inside the uncut casing. Then the mill deflector assembly is then lowered until the "locking" lugs 16 extend into the cut section of casing, and until finally the locking lugs land on the casing ledge 32 which has been created by milling or cutting away a section or interval of the well casing.

The device can then be oriented by landing a surface reading gyroscope in a landing profile that is located above or at the upper portion of the deflector shoe 14 and by rotating the deflector shoe as required to align a jet tube opening 34 with the intended orientation of a lateral passage to be formed. Or alternatively, laterals can be installed in various selected directions or azimuths into the surrounding formation from the casing interval.

The body structure 29 of the section mill 12 contains a cutter actuation piston assembly 30 which is connected to the cutter arms 28. These arms are connected by pins 33 to the body of the section mill 12. As the piston assembly is forced downward by pumped fluid, the cutter arms are forced outwardly responsive to piston energization by fluid pressure. The cutter devices 22 are fully extended when the cutter arms 28 are orientated at the substantially horizontal positions thereof.

For landing the casing mill and deflector tool a tool landing sub 27 is located between the deflector shoe 14 and the housing 12 and includes a landing body 18 having a plurality of "locking lugs" 16 which are spring loaded to extend radially outward. These lugs are kept in a compressed or retracted state until they reach the section of the casing which has been milled out, allowing the room required for the lugs to become extended. Once extended, these lugs will be positioned to land on the upper circular ledge 32 of the lower section of well casing and support the full weight of the Device and the work string 17 above it.

Functional and Structural Variations of the Section Mill Deflector Assembly:

The mill deflector 10 could be configured in a number of ways. The deflector shoe 14 could be an integral part of the device. Alternatively the "locking lugs" 16 could be built on an independent sub and attached to the section mill by a threaded or bolted connection. The mill deflector 10 could be configured to cut in either a downward or upward direction from the milled casing opening as desired.

The deflecting shoe 14 may be constructed from aluminum, stainless steel, heavy plastic or Teflon. The openings for circulation of drilling or completion fluid may have nothing inside or may contain a "one way" valve. The deflecting shoe may be connected to the production tubing or indexing tool by a threaded connection or may be bolted on.

Connections

The casing milling and jet deflector assembly is connected to the work string by a threaded connection. The deflector shoe is connected to the section mill by a threaded connection.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for a single run well service operation for cutting an interval in a well casing and positioning a deflector shoe relative to said interval, comprising:

running to a desired depth within a casing of a well a casing interval assembly having a casing mill and a jet tube deflector shoe, said deflector shoe having a jet tube transition passage therein and defining a jet tube outlet facing laterally;

moving and actuating said casing mill and cutting away a section of casing of desired length forming a casing interval exposing a surrounding earth formation, said actuation of said casing mill forming an upwardly facing landing ledge on the casing at said casing interval; and landing said casing interval assembly on said landing ledge, said landing step positioning said deflector shoe with said jet tube outlet located within said casing interval and facing the earth formation.

2. The method of claim 1, wherein a landing and positioning body is connected within said casing interval assembly and has locking lugs that are movable from a retracted position to an extended position, said method comprising:

after said step of moving and actuating said casing mill, moving said casing interval assembly upward within the casing and above said casing interval;

lowering said casing interval assembly within the casing until said locking lugs reach said casing interval and are moved from said retracted positions to said extended positions; and continuing said lowering of said casing interval assembly until said locking lugs engage and are stopped by said upwardly facing landing ledge and said jet tube outlet is located within said casing interval.

3. The method of claim 1, wherein said casing mill includes a fluid pressure responsive piston having actuating connection with cutter actuating arms and upon piston movement said actuating arms are moved and move said cutter members outwardly to engage and cut through the casing, said method comprising:

said step of moving and actuating said casing mill being increasing fluid pressure on said piston and causing pressure actuation of said cutter actuating arms and movement of said cutter members against the casing;

rotating said casing interval assembly and causing said cutter members to cut through the casing; and lowering and rotating said casing interval assembly and cutting away a section of casing of sufficient length to define said casing interval and form said upwardly facing landing ledge.

4. The method of claim 1, wherein said deflector shoe defines a jet tube transition passage having an inlet facing upwardly and an outlet facing laterally, said method comprising:

running a flexible jet fluid supply tube and jet nozzle down the well casing and through said jet tube transition passage of said deflector shoe; and pumping fluid from a surface location through said flexible jet fluid supply tube and directing a formation blasting jet of pressurized fluid against the formation and forming a lateral passage from the casing interval into the formation.

5. The method of claim 4, comprising:

after completion of the lateral passage, rotating said deflector shoe and orienting said outlet of said jet tube transition passage toward a selected azimuth; and repeating said step of pumping fluid from the surface location through said flexible jet fluid supply tube and directing a formation blasting jet of pressurized fluid against the formation and forming a lateral passage from the casing interval into the formation.

6. The method of claim 1, comprising:

extending a casing cutter member from said casing mill to casing cutting position thereof; and rotating said casing cutter and moving said casing cutter downwardly and cutting away a section of casing defining a casing interval exposing the formation, said downward cutting of the casing leaving a sharply defined upwardly facing circular landing ledge on the casing.

7. The method of claim 6, wherein said deflector shoe defines a jet tube transition passage having an inlet opening facing upwardly and an outlet opening facing laterally and has a landing positioning body having moveable locking lugs that move to retracted positions and landing positions, said method comprising:

after cutting the casing, retracting said casing cutter;

lifting said casing interval assembly within the casing to a position above the casing interval;

lowering said casing interval assembly until said locking lugs reach the casing interval and move from said retracted positions outwardly to said landing positions; and continuing lowering movement of said casing interval assembly within the casing until said locking lugs land on said sharply defined upwardly facing circular landing ledge and position said outlet opening of said jet tube transition passage in facing relation with the formation.

8. The method of claim 1, after cutting the casing interval in the casing, lifting said casing interval assembly within the casing to a position above the casing interval;

lowering and landing said casing interval assembly on said landing ledge;

running a flexible jet fluid supply tube and jet nozzle down the well casing and through said jet tube transition passage of said deflector shoe;

pumping fluid from a surface location through said flexible jet fluid supply tube and directing a formation blasting jet of pressurized fluid against the formation and forming a lateral passage from the casing interval into the formation;

after forming a lateral passage into the formation, with said casing interval assembly within the casing, lifting and rotating said casing interval assembly and orienting said outlet opening of said jet tube transition passage on another azimuth; and repeating said running of said flexible jet fluid supply tube and pumping fluid through said flexible jet fluid supply tube and forming another lateral passage within the formation.

9. Single run well servicing apparatus for cutting a casing interval in the casing of well, locating a jet tube deflector shoe relative to the casing interval, comprising:

a deflecting shoe having connection with a work string extending from a surface location and being linearly and rotatably moveable by the work string;

a tool positioning body being connected with said deflecting shoe;

a plurality of locking lugs being mounted within said tool positioning body and being movable to a retracted positions and to extended landing positions;

a section mill being connected with said tool positioning body and having a casing cutter member being hydraulically moveable from a retracted position to a cutting position;

a service fluid supply system being located at the surface location and having communication with said section mill and being selectively controlled for pressure energized movement of said casing cutter member to said cutting position responsive to the pressure of fluid being pumped.

10. The single run well servicing apparatus of claim 9, comprising:

said deflecting shoe defining a jet tube transition passage having an upwardly facing inlet opening and having a laterally facing outlet opening and directing a flexible jet fluid supply tube extending downwardly through the well casing to bend and transition laterally and extend from said laterally facing outlet opening into the surrounding formation responsive to fluid jet blasting.

11. The single run well servicing apparatus of claim 9, comprising:

a flexible jet fluid supply tube conducting pressurized fluid from said service fluid supply system and being movable through said jet tube transition passage and from said outlet opening to the formation; and a jet nozzle being mounted to said flexible jet fluid supply tube for providing high pressure fluid of said flexible jet fluid supply tube to a jet for jet blasting a lateral passage into the formation; and a reaction opening in said jet nozzle, directing fluid flow rearwardly and developing a reaction force responsive to fluid flow which propels said jet nozzle forwardly and develops a traction force urging said flexible jet fluid supply tube into a lateral passage being jet blasted into the formation.

12. The single run well servicing apparatus of claim 9, comprising:

said locking lugs being spring urged to said extended landing positions thereof; and said locking lugs having upwardly facing cam surfaces that engage a downwardly facing end of the casing at said casing interval and develop a reaction force upon upward movement of said casing interval assembly forcing said locking lugs from said extended position to said retracted position.

13. The single run well servicing apparatus of claim 9, comprising:

a downwardly converging tapered jet tube guide surface of said inlet opening of said deflecting shoe; and an overhang structure within said inlet opening minimizing hang-up of said jet fluid supply tube and jet nozzle during passage into and from said jet tube transition passage.

14. The single run well servicing apparatus of claim 9, comprising:

bypass passages being defined within said deflecting shoe and communicating said jet tube transition passage with an annulus between the well casing and said deflecting shoe.

* * * * *